US008561926B2

(12) United States Patent
Dallimore et al.

(10) Patent No.: US 8,561,926 B2
(45) Date of Patent: Oct. 22, 2013

(54) MATERIAL FEEDING DEVICE FOR VSI-CRUSHER

(75) Inventors: Rowan Dallimore, Bath (GB); George Fensome, Bristol (GB); Knut Kjaerran, Svedala (SE)

(73) Assignee: Sandvik Intellectual Property AB, Sandviken (SE)

( * ) Notice: Subject to any disclaimer, the term of this patent is extended or adjusted under 35 U.S.C. 154(b) by 497 days.

(21) Appl. No.: 12/588,191

(22) Filed: Oct. 7, 2009

(65) Prior Publication Data

US 2010/0108790 A1 May 6, 2010

(30) Foreign Application Priority Data

Oct. 8, 2008 (SE) ..... 0802112

(51) Int. Cl.
*B02C 19/06* (2006.01)
*B02C 23/00* (2006.01)

(52) U.S. Cl.
USPC ..... 241/5; 241/26; 241/275

(58) Field of Classification Search
USPC ..... 241/5, 26, 275
See application file for complete search history.

(56) References Cited

U.S. PATENT DOCUMENTS

| | | | | |
|---|---|---|---|---|
| 3,612,415 | A | 10/1971 | Merges | |
| 3,701,485 | A | 10/1972 | Kimble et al. | |
| 4,515,316 | A | 5/1985 | Kawaguchi | |
| 4,662,571 | A * | 5/1987 | MacDonald et al. | 241/81 |
| 5,145,118 | A * | 9/1992 | Canada | 241/81 |
| 6,416,000 | B1 * | 7/2002 | Lusty et al. | 241/275 |
| 6,783,092 | B1 | 8/2004 | Robson | |
| 7,350,725 | B2 * | 4/2008 | Dallimore et al. | 241/5 |
| 2005/0263636 | A1 * | 12/2005 | Hur et al. | 241/275 |
| 2006/0011761 | A1 * | 1/2006 | Dallimore et al. | 241/275 |
| 2007/0246588 | A1 * | 10/2007 | Hur et al. | 241/275 |

FOREIGN PATENT DOCUMENTS

WO WO 2004/020103 3/2004

* cited by examiner

*Primary Examiner* — Faye Francis
(74) *Attorney, Agent, or Firm* — Morgan, Lewis & Bockius LLP

(57) ABSTRACT

A vertical shaft impact crusher for crushing material including a rotor for accelerating a first flow of material to be crushed, a first feed device for feeding the first flow of material to the rotor, a housing that includes a circumferential impact wall section against which the accelerated first flow of material may be crushed, and a second feed device for feeding a second flow of material to be crushed into the path of the accelerated first flow of material. The second feed device includes an inner hopper and an outer hopper. The inner hopper includes at least one outlet for allowing the second flow of material to enter a space formed between the inner and outer hoppers. A slide plate inclined substantially tangential in relation to the rotor is located adjacent the at least one outlet in the space between the inner and outer hoppers.

14 Claims, 3 Drawing Sheets

MATERIAL FEEDING DEVICE FOR VSI-CRUSHER

CROSS REFERENCE TO RELATED APPLICATIONS

This application claims priority from Swedish patent application No. 0802112-3, filed on Oct. 8, 2008, the subject matter of which is incorporated herein by reference.

TECHNICAL FIELD

The present disclosure relates to a vertical shaft impact crusher for crushing material. The crusher includes a rotor for accelerating a first flow of material to be crushed, a first feed means for vertically feeding the first flow of material to the rotor, a housing comprising a circumferential impact wall section against which the accelerated first flow of material may be crushed, and a second feed means for feeding a second flow of material to be crushed into the path of the accelerated first flow of material.

The disclosure also relates to a method for crushing material using a vertical impact crusher that includes a rotor for accelerating a first flow of material to be crushed, a first feed means for vertically feeding the first flow of material to the rotor, a housing comprising a circumferential impact wall section against which the accelerated first flow of material may be crushed, and a second feed means for feeding a second flow of material to be crushed into the path of the accelerated first flow of material.

BACKGROUND

Vertical shaft impact crushers (VSI-crushers) are used in many applications for crushing hard material like rocks, ore etc. WO 2004/020103 describes a VSI-crusher comprising a housing and a horizontal rotor located inside the housing. Two separate material flows may be fed to the crusher. A first material flow is fed to the rotor via an opening in the top thereof. The first material flow is accelerated by the rotor and is ejected towards the wall of the housing. A second material flow is fed outside the rotor, for example, between the rotor and the housing. This second material flow is hit by the first material flow ejected by the rotor. Thus the first and second material flows are crushed against each other just outside the rotor.

In some situations the operation of the crusher described in WO 2004/020103 may be disturbed by problems in the feeding of the second material flow. Such problems reduce the crushing efficiency of the crusher and increase the need for maintenance work.

SUMMARY

It is desired to provide a crusher which reduces the problems of the second material flow.

This can be accomplished by an exemplary vertical shaft impact crusher for crushing material comprising a rotor for accelerating a first flow of material to be crushed, a first feed means for feeding the first flow of material to the rotor, a housing comprising a circumferential impact wall section against which the accelerated first flow of material may be crushed, and a second feed means for feeding a second flow of material to be crushed into the path of the accelerated first flow of material, the second feed means comprising an inner hopper and an outer hopper, the inner hopper including at least one outlet for allowing said second flow of material to enter a space formed between said inner and outer hoppers, a slide plate adjacent to said at least one outlet is located in the space between said inner and outer hoppers, the slide plate is inclined in a direction being substantially tangential in relation to the rotor, such that material leaving said at least one outlet will slide on the slide plate and obtain a movement in a direction having a substantially tangential component in relation to the rotor.

An advantage of this crusher is that the second flow of material will flow at a high speed over the slide plate, which reduces the risk of material piling up at the outlet of the inner hopper. This is particularly advantageous when crushing materials having a flaky consistency, and materials comprising a substantial amount of needle like objects. This is also particularly advantageous when crushing materials comprising a few objects that are considerably larger than the average size of the material, and materials that are wet. In addition to avoiding the build-up of piles of material at the outlet, and avoiding the blocking of the outlet itself, the exemplary embodiments may also contribute to a more efficient crushing effect, since the second flow of material is fed into the path of the first flow of material as a more even flow of material, and at a higher speed.

According to one embodiment, the angle between a horizontal plane and the slide plate is from about 35° to about 70°. An angle of less than 35° provides the second flow of material with speed that is too low, which reduces the crushing efficiency and provides a risk that material may pile up on the slide plate itself. An angle of more than 70° may reduce the tangential component of the second flow of material, such that the second flow of material passes through the path of the accelerated first flow of material in a less efficient manner, thereby reducing the crushing efficiency.

According to a specific embodiment, the slide plate is provided with a wear resistant coating on the surface on which said second flow of material is operative to slide. The wear resistant coating increases the life of the slide plate. In a more specific embodiment, the wear resistant coating has a low coefficient of friction, to further increase the speed at which the second flow of material slides over the slide plate.

According to one embodiment, the open area of the at least one outlet is adjustable. An advantage of this embodiment is that the amount of the second flow of material can be varied.

According to one embodiment, an adjustment device is connected to the slide plate, such that the angle between the slide plate and a horizontal plane may be adjusted. An advantage of this embodiment is that the angle between the slide plate and the horizontal plane may be adjusted to a suitable value for various materials. For materials having wet or "sticky" properties a larger angle may be suitable, compared to materials having "dry" properties.

A further desire is to provide a method of crushing material, by which method a second flow of material is more efficiently introduced into the path of an accelerated first flow of material.

This is achieved by a method of crushing material comprising the steps of feeding a first flow of material to be crushed to a rotor rotating around a vertical axis, accelerating said first flow of material in said rotor towards an impact wall section of a housing surrounding the rotor, feeding a second flow of material through at least one outlet of an inner hopper to a space formed between said inner hopper and an outer hopper surrounding said inner hopper, allowing said second flow of material to slide on a slide plate located in said space adjacent to said at least one outlet, wherein the slide plate is inclined in a direction substantially tangential in relation to the rotor, such that material leaving said at least one outlet will slide on the slide plate and obtain a movement in a direction having a substantially tangential component in relation to the rotor; and feeding the second flow of material to be crushed into the path of the accelerated first flow of material.

An advantage of this embodiment is that the second flow of material is more efficiently introduced into the path of the accelerated first flow of material.

Further objects and features of the present invention will be apparent from the description and the claims.

BRIEF DESCRIPTION OF THE DRAWINGS

The invention will hereafter be described in more detail and with reference to the appended drawings.

DETAILED DESCRIPTION OF PREFERRED EMBODIMENTS

Figure 1:
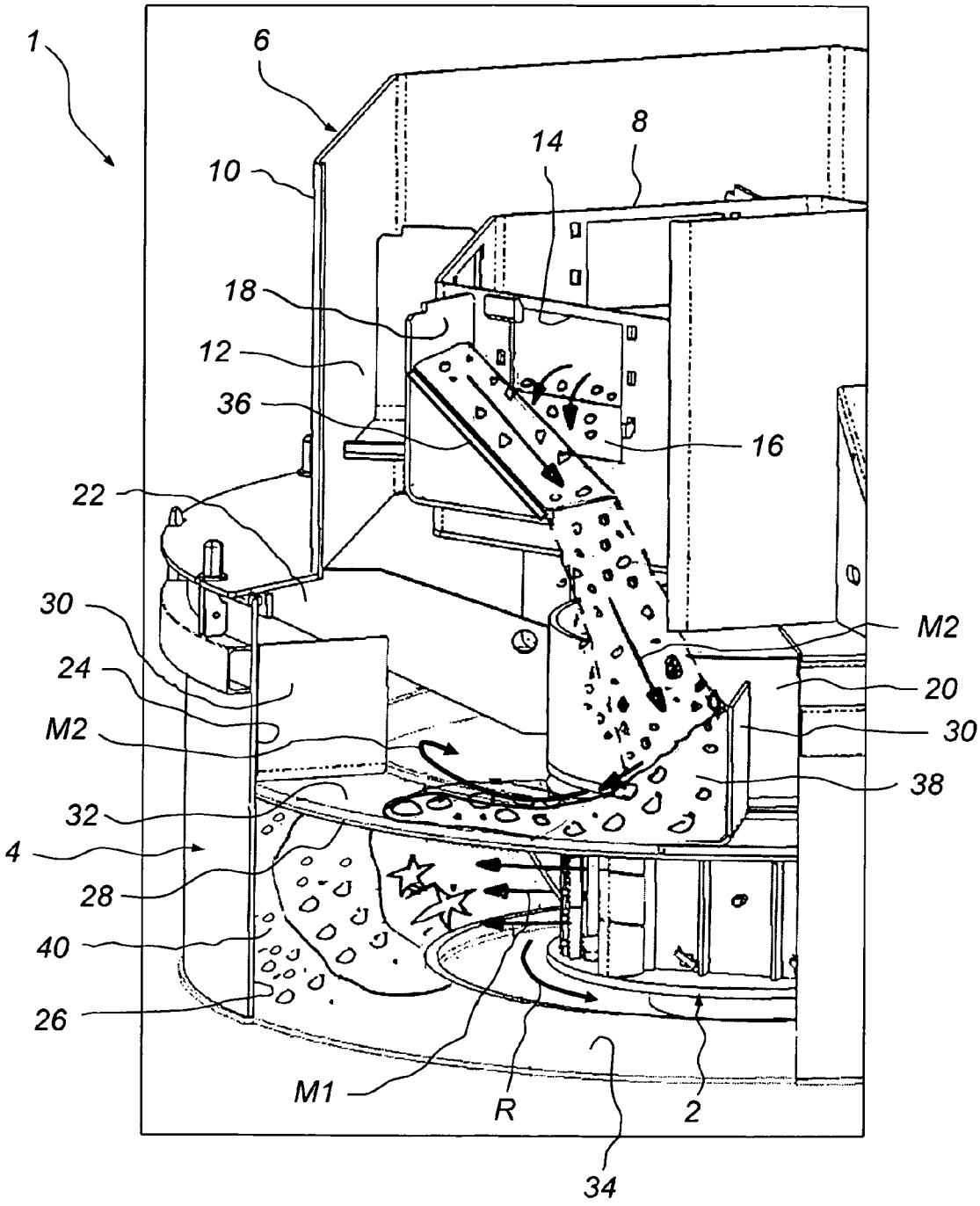
FIG. 1 is a three dimensional view, partly in section, of a portion of an exemplary vertical shaft impact crusher that illustrates the pathway of the second flow of material.

In FIG. 1 a vertical shaft impact crusher 1 is shown, partly in cross-section. A rotor 2 is located inside a housing 4 of the crusher 1. At the top of the crusher 1 a feed hopper means 6 is located. The feed hopper means 6 has a hexagonal inner hopper 8, and a hexagonal outer hopper 10 surrounding said inner hopper 8. A roof, not shown in FIG. 1, seals a space 12 formed between the inner hopper 8 and the outer hopper 10 from above. The inner hopper 8 is provided with six outlets 14, each such outlet 14 being located at a side of the hexagonal inner hopper 8. Each outlet 14 is provided with a movable hatch 16. The movable hatch 16 may be placed in different positions on the inner hopper 8 to obtain a desired open area of the respective outlet 14. An "L"-shaped direction arm 18 is fixed between the inner hopper 8 and the outer hopper 10 adjacent to each of the outlets 14, in said space 12. Below the inner hopper 8 a central feeding cylinder 20 is placed. The feeding cylinder 20 is fixed to the inside of the housing 4 with the aid of three beams, of which only the beam 22 is shown in FIG. 1.

A circumferential distributing wall section 24 is located at the same level as the feeding cylinder 20. Below the distributing wall section 24 and on the same level as the rotor 2 a circumferential impact wall section 26 is located. A cavity ring 28 separates the distributing wall section 24 from the impact wall section 26. A number of vertical collection plates 30, which extend radially with respect to the rotor 2, are fixed to the upper surface 32 of the cavity ring 28. A bed retention ring 34 is located at the bottom of the crusher 1.

The operation of the crusher 1 will now be described in more detail with reference to FIG. 1. Material to be crushed is fed to the inner hopper 8. A first flow of material M1 will reach the rotor 2 via an inlet at the bottom of the inner hopper 8 and the feeding cylinder 20, and a second flow of material M2 will be forwarded outside of the rotor 2 via the outlets 14. By varying the position of the respective hatches 16 covering the outlets 14 the amount of the second flow of material M2 can be adjusted. An arrow R indicates the direction of rotation of the rotor 2.

The direction arm 18 is provided with a slide plate 36, as will be described hereinafter. The slide plate 36 is inclined in a direction being substantially tangential in relation to the rotor 2. The second flow of material M2 leaving the outlet 14 will slide on the slide plate 36 in a direction being substantially tangential in relation to the rotor 2, the second flow of material M2 thus obtaining a movement in a direction having a substantially tangential component in relation to the rotor 2. The second flow of material M2 will thus in a first step be directed towards the distributing wall section 24. At the location of the distributing wall section 24 where the second flow of material M2 would impinge the wall section 24 the collection plate 30 is located. During the first minutes of crusher operation the second flow of material M2 will build a hillside 38 of material against the collection plate 30 and the upper surface 32 of the cavity ring 28. After the hillside 38 has been established the rest of the second flow of material M2 will, in a second step, slide on the second hillside 38. The second flow of material M2 will thus, in this second step, obtain a movement having a substantially tangential component in relation to the rotor 2. The second flow of material M2 will then pass on down into a position adjacent to the impact wall section 26. Adjacent to the impact wall section 26 the second flow of material M2, having a movement with a substantially tangential component, will be hit by the first flow of material M1 ejected by the rotor 2, which will result in efficient crushing of both material flows M1 and M2. A bed of retained material 40, against which the two flows of material M1 and M2 may impact, is built up on the bed retention ring 34 during operating of the crusher 1, and protects the impact wall section 26 from wear.

Figure 2:
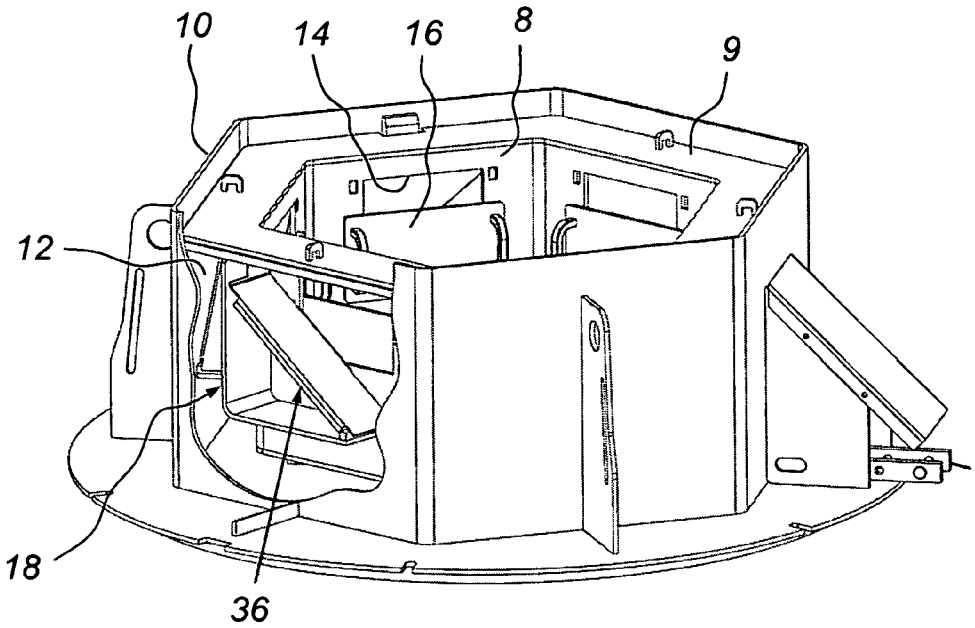
FIG. 2 is a three dimensional view, partly in section, of a portion of an exemplary vertical shaft impact crusher that illustrates the inner and outer hoppers.

FIG. 2 illustrates the inner and outer hoppers 8, 10 in more detail and when there is no flow of material in the crusher. The inner hopper 8 is provided with the outlets 14, the open height of each individual outlet 14 being controllable by means of adjusting the vertical position of the respective movable hatch 16. The direction arm 18 is located between the inner and outer hoppers 8, 10, such that material flowing through the respective outlet 14 will land on the respective slide plate 36. A roof 9 covers the space 12 from above, such that material may only enter the space 12 formed between the inner and outer hoppers 8, 10 via the outlets 14.

Figure 3:
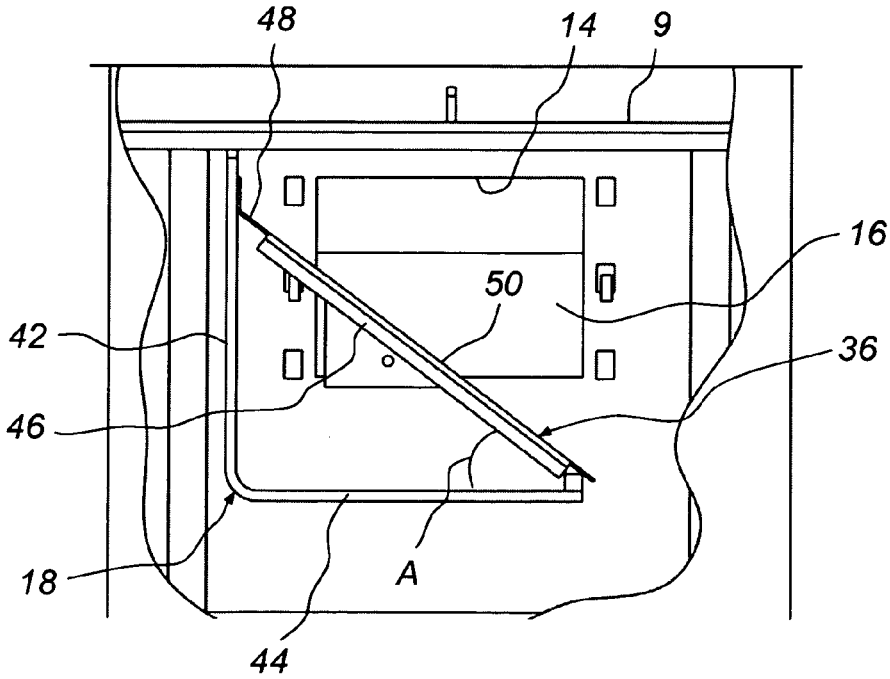
FIG. 3 is a side view of a portion of an exemplary vertical shaft impact crusher that illustrates a slide plate.

FIG. 3 illustrates the direction arm 18 in more detail, as seen from the side thereof. The direction arm 18 is provided with a vertical leg 42 and a horizontal leg 44. The slide plate 36 has been mounted on the direction arm 18 to form a hillside sloping downwards from the upper portion of the vertical leg 42 towards the right portion of the horizontal leg 44, as illustrated in FIG. 3. The angle A between the slide plate 36 and the horizontal plane can be in the range of about 35° to about 70°, particularly in the range of about 40° to about 50°, to enable the material coming from the outlet 14 to slide quickly over the slide plate 36, without getting stuck on the slide plate 36.

The slide plate 36 includes a backing plate 46 providing the mechanical strength and rigidity of the slide plate 36. The backing plate 46 is attached to a bracket plate 48 which is mounted to the vertical leg 42 and the horizontal leg 44. The surface 50 of the backing plate 46 is provided with a coating providing low friction and good wear characteristics to the surface 50. Examples of suitable coatings include ceramic coatings, such as aluminium oxide or zirconium oxide, for example, materials that have a good wear resistance and a comparably low friction coefficient.

The slide plate 36, having good wear characteristics and low friction, is particularly useful when crushing materials that tend to form sticky aggregates. Such materials, including, for example, wet materials and needle like materials, will slide efficiently on the slide plate 36 and further down to the distributing wall section 24, illustrated in FIG. 1, without getting stuck just outside the outlets 14, as might happen in the technique in accordance with the prior art.

Figure 4:
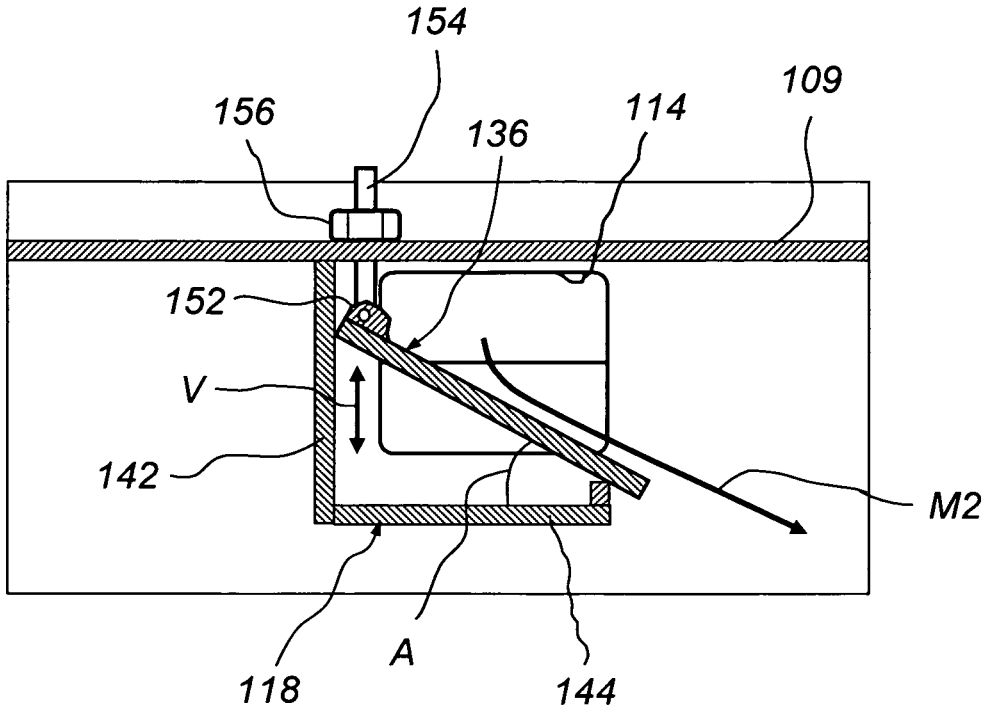
FIG. 4 is a side view of a portion of an exemplary vertical shaft impact crusher that illustrates a slide plate according to an alternative embodiment.

FIG. 4 illustrates an alternative embodiment of the present invention. A direction arm 118, being located adjacent to an outlet 114 being similar to the outlets 14 described hereinbefore with reference to FIGS. 1-3, is provided with a vertical leg 142 and a horizontal leg 144. A slide plate 136 has been mounted on the direction arm 118 to form a hillside sloping downwards from the upper portion of the vertical leg 142 towards the right portion of the horizontal leg 144, as illustrated in FIG. 4. At its upper end the slide plate 136 is provided with a bracket 152, which is attached to a bolt 154. The vertical position of the bolt 154 may be adjusted by means of turning a nut 156 abutting a roof 109 of the crusher.

The angle A between the slide plate 136 and the horizontal plane may be adjusted by means of turning the nut 156, such that the bolt 154 and the bracket 152, and hence the upper end of the slide plate 136, is moved in the vertical direction, as indicated by means of a vertical arrow V. During this movement the lower end of the slide plate 136 pivots around the right end, as seen in FIG. 4, of the horizontal leg 144. Hence, by turning the nut 156 the angle A may adjusted in the range of, for example, from about 35° to about 70°. Hence, it is possible to adjust the angle A to a suitable value, depending on the properties of the material to be crushed, to enable the material coming from the outlet 114, the path of the second flow of material being indicated by means of an arrow M2, to slide quickly over the slide plate 136, without getting stuck on the slide plate 136.

It will be appreciated that numerous modifications of the embodiments described above are possible within the scope of the appended claims.

Above it has been described that the slide plate 36 is provided with a wear resistant coating. It will be appreciated that the slide plate may, in itself, be made from a wear resistant material, such as a ceramic material or a steel material, such as manganese steel, or other materials used for VSI-crusher wear parts.

Hereinbefore the inner and outer hoppers 8, 10 have been described as being hexagonal hoppers. It will be appreciated that the hoppers may have other shapes as well. Hence, the hoppers may, as alternative, be circular, square, pentagonal, etc., in shape.

Hereinbefore the slide plate 36 has been described as being attached to an "L"-shaped direction arm 18. It will be appreciated that the slide plate 36 may, as alternative, be mounted in said space 12 in another manner. For example, the slide plate 36 may be mounted to the hoppers 8, 10 by means of other types of brackets, or may be mounted directly to the hoppers, or to the roof, without the need of any "L"-shaped direction arm.

Although described in connection with preferred embodiments thereof, it will be appreciated by those skilled in the art that additions, deletions, modifications, and substitutions not specifically described may be made without departure from the spirit and scope of the invention was defined in the appended claims.

The invention claimed is:

1. A vertical shaft impact crusher for crushing material, said crusher comprising a rotor for accelerating a first flow of material to be crushed, a first feed means for feeding the first flow of material to the rotor, a housing comprising a circumferential impact wall section against which the accelerated first flow of material may be crushed, and a second feed means for feeding a second flow of material to be crushed into the path of the accelerated first flow of material, the second feed means comprising an inner hopper and an outer hopper, the inner hopper including at least one outlet for allowing said second flow of material to enter a space formed between said inner and outer hoppers, a slide plate adjacent to said at least one outlet is located in the space between said inner and outer hoppers, the slide plate is inclined in a direction being substantially tangential in relation to the rotor, such that material leaving said at least one outlet will slide on the slide plate and obtain a movement in a direction having a substantially tangential component in relation to the rotor, wherein an adjustment device is connected to the slide plate to adjust an angle between the slide plate and a horizontal plane; and wherein a direction arm is fixed between the inner and outer hoppers, the slide plate being mounted on the direction arm, and, when viewed in a direction perpendicular to the horizontal plane, a portion of the slide plate extends past an edge of the direction arm in the direction having the substantially tangential component in relation to the rotor.

2. The crusher according to claim 1, wherein said slide plate includes a wear resistant coating on the surface on which said second flow of material is operative to slide.

3. The crusher according to claim 2, wherein said coating is a ceramic coating.

4. The crusher according to claim 1, wherein the angle between the horizontal plane and the slide plate is from about 35° to about 70°.

5. The crusher according to claim 4, wherein said slide plate includes a wear resistant coating on the surface on which said second flow of material is operative to slide.

6. The crusher according to claim 5, wherein said coating is a ceramic coating.

7. The crusher according to claim 1, wherein an open area of said at least one outlet is adjustable.

8. The crusher according to claim 1, wherein the adjustment device includes a bolt connected to the slide plate, the bolt and a nut protruding from a roof of the crusher above the slide plate, and the nut abutting the roof such that turning the nut moves the bolt and the slide plate.

9. A method of crushing material, said method comprising the steps of:

feeding a first flow of material to be crushed to a rotor rotating around a vertical axis, accelerating said first flow of material in said rotor towards an impact wall section of a housing surrounding the rotor, feeding a second flow of material through at least one outlet of an inner hopper to a space formed between said inner hopper and an outer hopper surrounding said inner hopper, allowing said second flow of material to slide on a slide plate located in said space adjacent to said at least one outlet, wherein the slide place is inclined in a direction substantially tangential in relation to the rotor, such that material leaving said at least one outlet will slide on the slide plate and obtain a movement in a direction having a substantially tangential component in relation to the rotor, and wherein an angle between a horizontal plane and the slide plate is adjusted via an adjustment device; and feeding the second flow of material to be crushed into the path of the accelerated first flow of material, wherein a direction arm is fixed between the inner and outer hoppers, the slide plate being mounted on the direction arm, and, when viewed in a direction perpendicular to the horizontal plane, a portion of the slide plate extends past an edge of the direction arm in the direction having the substantially tangential component in relation to the rotor.

10. The method according to claim 9, wherein an angle between a horizontal plane and the slide plate is from about 35° to about 70°.

11. The method according to claim 9, wherein said slide plate includes a wear resistant coating on the surface on which said second flow of material is allowed to slide.

12. The method according to claim 11, wherein said coating is a ceramic coating.

13. A vertical shaft impact crusher for crushing material, said crusher comprising a rotor for accelerating a first flow of material to be crushed, a first feed means for feeding the first flow of material to the rotor, a housing comprising a circumferential impact wall section against which the accelerated first flow of material may be crushed, and a second feed means for feeding a second flow of material to be crushed into the path of the accelerated first flow of material, the second feed means comprising an inner hopper and an outer hopper, the inner hopper including at least one outlet for allowing said second flow of material to enter a space formed between said inner and outer hoppers, a slide plate adjacent to said at least one outlet is located in the space between said inner and outer hoppers, the slide plate is inclined in a direction being substantially tangential in relation to the rotor, such that material leaving said at least one outlet will slide on the slide plate and obtain a movement in a direction having a substantially tangential component in relation to the rotor, wherein an adjustment device is connected to the slide plate to adjust an angle between the slide plate and a horizontal plane;

wherein a direction arm is fixed between the inner and outer hoppers, the slide plate being mounted on the direction arm, and, when viewed in a direction perpendicular to the horizontal plane, a portion of the slide plate overlaps an edge of the direction arm in the direction having the substantially tangential component in relation to the rotor;

wherein the at least one outlet of the inner hopper has a movable hatch configured to be placeable in different positions on the inner hopper to obtain a desired open area of the at least one outlet;

wherein a blocking device is located underneath the slide plate such that the angle between the slide plate and the horizontal plane is adjusted together with a position placement of the blocking device; and wherein the slide plate includes a wear resistant coating on the surface on which the second flow of material is operative to slide, and the coating is a ceramic coating.

14. The crusher according to claim 13, wherein the blocking device located underneath the slide plate is positioned in an opening of the hatch below the slide plate to minimize material flow below the slide plate.

* * * * *